US006752285B1

(12) United States Patent
Scalf

(10) Patent No.: US 6,752,285 B1
(45) Date of Patent: Jun. 22, 2004

(54) STORAGE AND SHIPPING BIN

(76) Inventor: Wallace J. Scalf, 4504 Paleo Pines Cir., Fort Pierce, FL (US) 34951

( * ) Notice: Subject to any disclaimer, the term of this patent is extended or adjusted under 35 U.S.C. 154(b) by 0 days.

(21) Appl. No.: 10/118,298

(22) Filed: Apr. 8, 2002

(51) Int. Cl.[7] ..... B65D 6/24
(52) U.S. Cl. ..... 220/4.32; 220/1.5
(58) Field of Search ..... 220/1.5, 4.33, 220/4.32, 4.31

(56) References Cited

U.S. PATENT DOCUMENTS

| | | | | |
|---|---|---|---|---|
| 1,757,664 A | | 5/1930 | Goman | |
| 2,648,409 A | | 8/1953 | Daugherty | 189/2 |
| 3,182,846 A | * | 5/1965 | La Kaff | 108/156 |
| 3,266,656 A | | 8/1966 | Kridle | 220/4 |
| 3,736,035 A | | 5/1973 | Brown et al. | 312/107 |
| 3,966,072 A | | 6/1976 | Gonzales et al. | 220/7 |
| 3,999,676 A | | 12/1976 | Trebilcock et al. | 220/6 |
| 4,422,558 A | | 12/1983 | Mittelmann et al. | 220/1.5 |
| 4,558,797 A | | 12/1985 | Michell | 220/84 |
| 4,820,383 A | | 4/1989 | Shchamorov et al. | 220/6 |
| 5,236,099 A | | 8/1993 | Fties et al. | 220/4.31 |
| 5,413,236 A | | 5/1995 | Kenevan | 220/4.28 |
| 5,558,242 A | | 9/1996 | Kuan | 220/4.31 |
| 5,638,973 A | | 6/1997 | Dewey et al. | 220/4.33 |
| 5,765,707 A | * | 6/1998 | Kenevan | 220/4.28 |
| 5,862,931 A | | 1/1999 | Cox et al. | 220/6 |

FOREIGN PATENT DOCUMENTS

DE 4137095 A1 * 5/1993

* cited by examiner

*Primary Examiner*—Stephen Castellano
(74) *Attorney, Agent, or Firm*—Malin, Haley & DiMaggio, P.A.

(57) ABSTRACT

A modular container or bin with preferably four identical sidewalls held in place by four identical corner posts, with the sidewalls and corner posts both connected to a common base palette. The sidewalls are removably connected to the corner posts by interlocking slip joints. This slip joint configuration also removably connects the sidewalls to the base palette. The corners are secured to the base palette using four plastic bolts. The base palette has cutouts, to define feet and to provide for forklift (or other lifting devices) arm access in at least two directions. The sidewalls can also be designed for lifting by a claw lifting apparatus. The corner posts include a notch to allow cables to be secured during transportation. The container is designed primarily for the storage and transportation of agricultural products, though other uses are also possible.

35 Claims, 5 Drawing Sheets

20

20
28
40
120
122
130
90
34
42
44
46
48

STORAGE AND SHIPPING BIN

FIELD OF INVENTION

This invention relates to shipping and storage bins and containers, and more particularly to a collapsible shipping and storage bin which can be used in the transportation and storage of agricultural products.

BACKGROUND OF THE INVENTION

Storage containers transported on standard truck trailers are used to move agricultural products from one processing location to another. The use of single-piece storage containers typically prevents the maximum use of storage space use of storage. When the storage containers are transported empty, there is a loss of profit for the trucking industry. Additionally, typical transport of full or empty containers requires the use of relatively expensive bracket assembly for securement of the containers by a winch/cable assembly. Furthermore, over time the storage containers become damaged from normal wear and tear. Once damaged, the entire container is replaced.

Accordingly, what is needed in the art is a storage container or bin which is collapsible to increase storage space when transporting empty containers and which will permit for replacement of a section of the container that is damaged as opposed to the replacement of the entire container.

It is, therefore, to the effective resolution of the aforementioned problems and shortcomings of the prior art that the present invention is directed.

SUMMARY OF THE INVENTION

The present invention a storage container or bin ("bin") which generally includes a base, four sidewalls and four corner posts. The bin can be generally square shaped, with each sidewall being the same and each corner post the same. Each sidewall can be provided with a first side flange, a second side flange and a bottom flange. At least the lower inner area of each sidewall can be curved to help prevent or reduce damage to the contents stored within the bin (e.g. fruit, vegetables, etc.). One or more of the sidewalls can also be provided with one or more bushel markers.

A plurality of cutouts can be provided at the top area of each sidewall to define a gripping area and allow the bin to be moved by a conventional claw lifting apparatus. A ticket/card/label holder can also be provided along an outer surface of the sidewall(s) for holding identification or content information. Preferably, the holder can be positioned along a lower half of the sidewall and recessed to help prevent the card/label/ticket from being damaged by the claw lifting apparatus.

The base member is preferably provided with four groves extending along its perimeter edges. Each groove receives an associated bottom flange of a sidewall when assembling the bin. The bottom flange of the sidewall is slid into the base groove from either end of the groove. The configuration of the bottom flange preferably corresponds to the configuration of the base groove, such that, the sidewall cannot be pulled out of secured attachment to the base.

One or more feet can be secured to the bottom surface of the base. The locations of the feet along the bottom surface of the base are preferably chosen to permit forklift prongs or a similar device to lift the bin from any side. One or more of perimeter located feet can also be offset for aiding in stacking of the bins.

The corner posts provide further securement and retainment of the sidewalls in their vertical positions with respect to the base. Each corner post is provided with a first groove and a second groove. Each first groove receives a second flange of one of the sidewalls and each second groove receives a first flange of another one of the sidewalls. To secure each of the corner posts to two of the sidewalls, the sidewalls are preferably secured to base as described above, and the corner post grooves are aligned with corresponding sidewall flanges. The corner post is then slid down until the bottom surface of corner post preferably abuts the top surface of the base.

To further retain the corner posts in their vertical position and/or to secure the corner posts directly to the base, an attachment assembly can be provided. In one embodiment, the attachment assembly can include a threaded sleeve or insert ("sleeve"), preferably constructed from metal, which is disposed within a bottom aperture of the corner posts, an aperture disposed within the base, and a threaded bolt/screw. The insert or sleeve can be precast into the bottom aperture of the corner posts. In this embodiment, when the corner posts are properly positioned, the bottom aperture and the base aperture are aligned with each other. The bolt is inserted within the apertures and tightened by the mating of the threads on the bolt with the threads of the sleeve. In an alternative attachment assembly, a self-tapping bolt can be provided. The diameter of self-tapping bolt is chosen such that it is tightly received and retained within the apertures.

A top portion of the corner posts can preferably recessed to correspond to the offset portion of one of the base feet for stacking purposes. This configuration helps to eliminate any significant horizontal movement and/or shifting of the stacked bins during transit.

One or more, and preferably all, of the corner posts can be provided with a notch for receipt or disposal of a cable from a winch assembly disposed on a truck when transporting full or empty bins. The notch eliminates the need for expensive brackets currently used in transporting shipping containers. An aperture can also be provided at the top of the corner post(s) for receipt of a portion of a hook member, such as but not limited to a S hook. The hook also receives the winch assembly cable.

Additionally, a plurality of collapsed sidewalls and corner posts can be stored with an assembled bin, to reduce the space required for transporting back a plurality of empty bins, as compared to prior art containers. Preferably, the bin can be constructed from plastic. In the event that a portion (e.g. sidewall, base or corner post) of the bin becomes damaged, that portion is simply replaced. Thus, the entire bin or container does not have to be replaced.

The capacity to disassemble a storage container and make the maximum use of profitable space is one benefit of modular storage container. The added ability to replace deteriorated sections of the containers allows the partial repair instead of total replacement of the containers allows for further profits.

It is therefore an object of the present invention to provide a shipping container that is collapsible.

It is another object of the present invention to provide a shipping container that is collapsible that permits replacement of a damaged portion without having to discard the remaining useful portions of the container.

It is a further object of the present invention to provide a shipping container that is collapsible such that less space is required in shipping empty bins.

It is to be understood that both the foregoing general description and the following detailed description are explanatory and are not restrictive of the invention as claimed. The accompanying drawings, which are incorporated in and constitute part of the specification, illustrate embodiments of the present invention and together with the general description, serve to explain principles of the present invention.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which:

FIG. 7 is a side elevational view of the invention shown in FIG. 1 illustrating the invention stacked and in transit;

DETAILED DESCRIPTION OF THE PREFERRED EMBODIMENT

Figure 1:
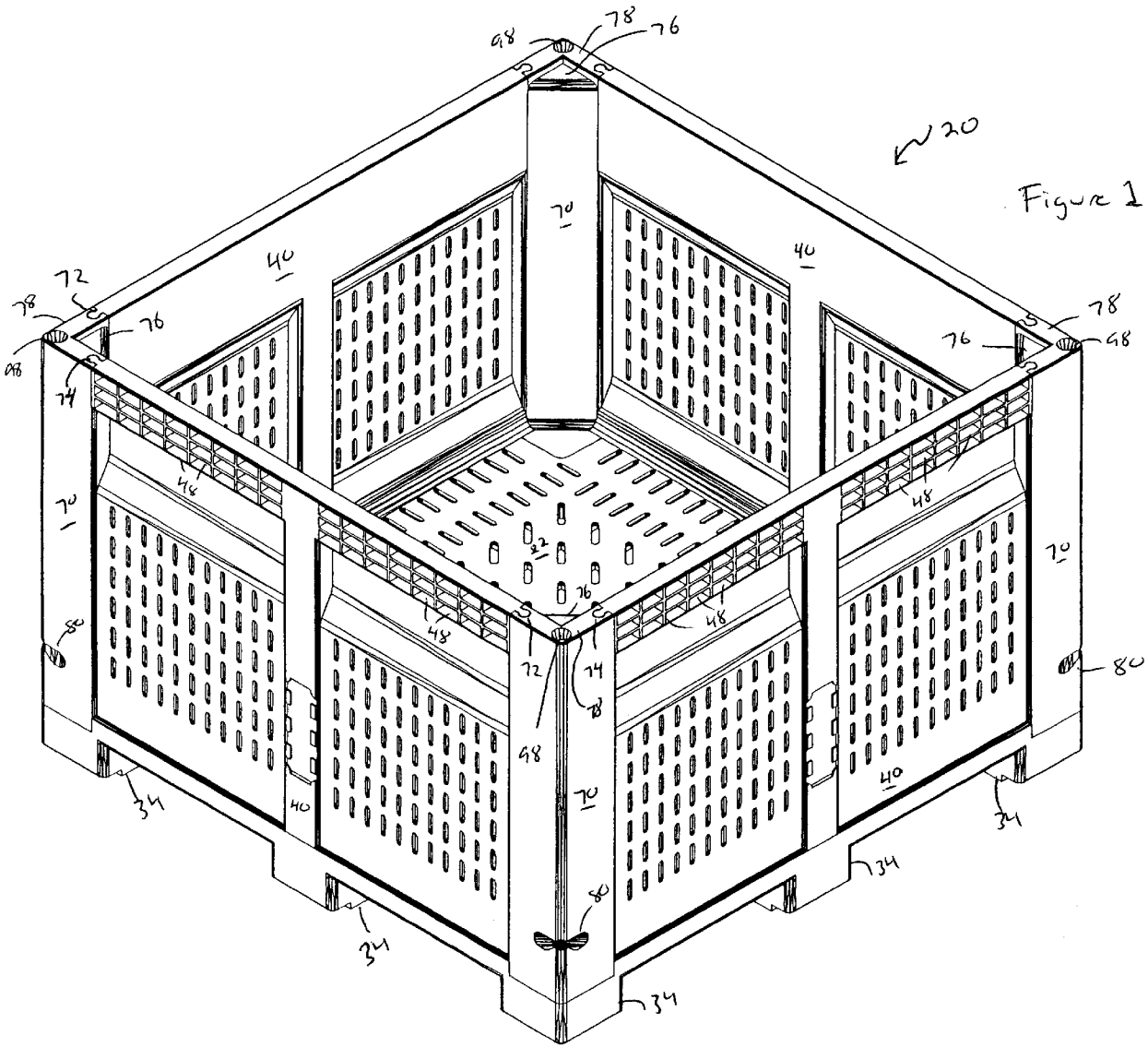
FIG. 1 is a perspective view of the storage bin/container ("bin") in accordance with the present invention.
Figure 2:
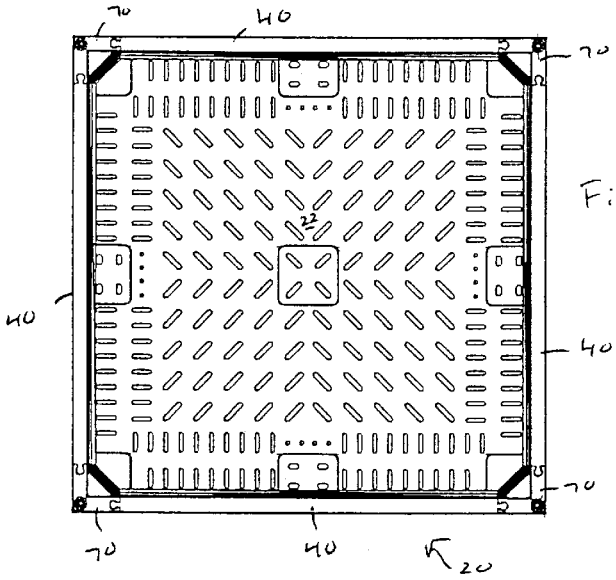
FIG. 2 is a top view of the invention shown in FIG. 1.

As seen in FIG. 1, a storage container or bin ("bin") in accordance with the present invention is illustrated and generally designated as bin 20. Bin 20 preferably includes a base 22, four sidewalls 40 and four corner posts 70. Bin 20 can be generally square shaped, though such is not considered limiting and other shapes, such as, rectangular, can also be used and are considered within the scope of the invention. Where a square shaped bin 20 is provided, each sidewall 40 can be preferably the same and each corner posts 70 can be the same.

Figure 4:
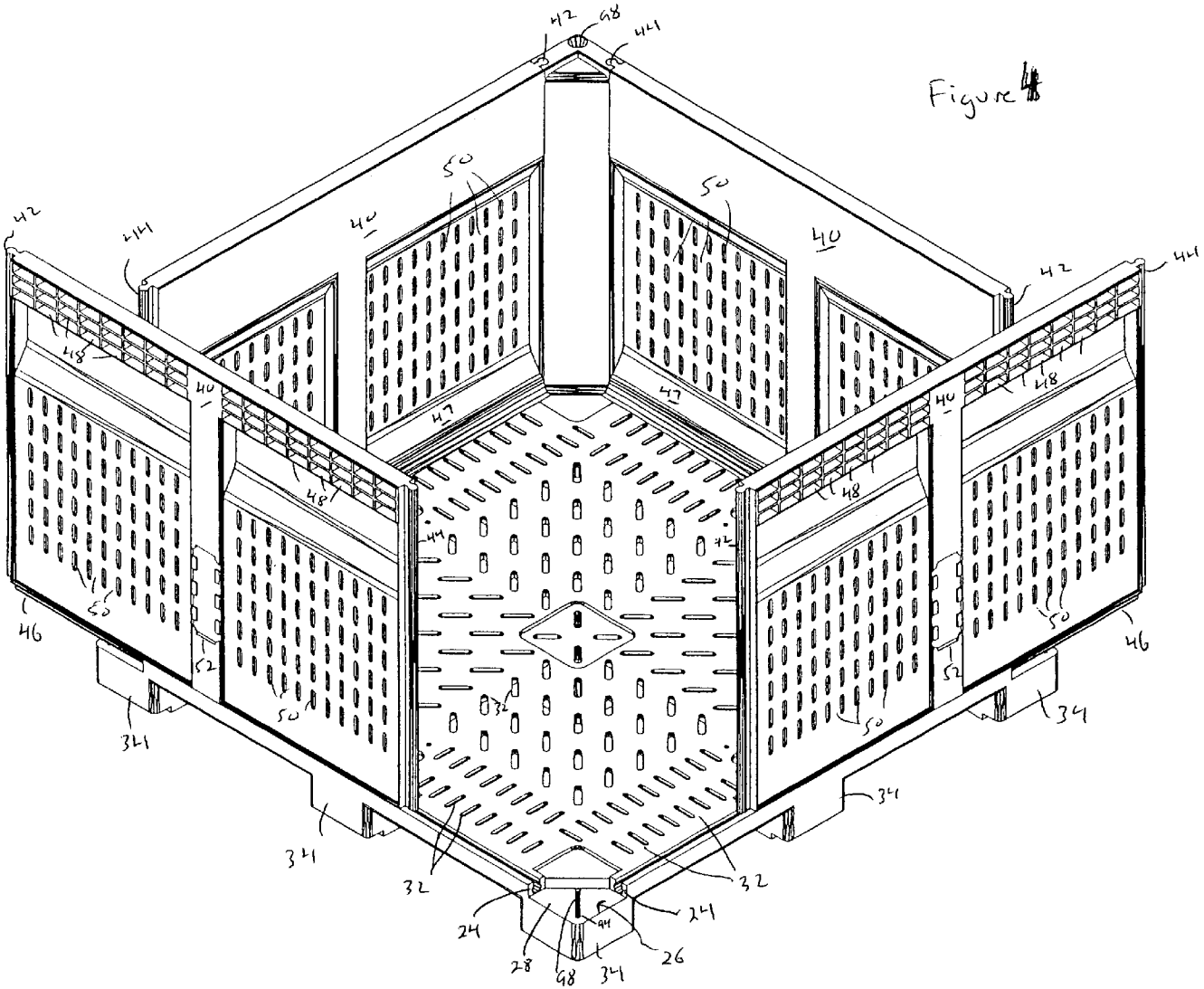
FIG. 4 is a perspective view of the invention shown in FIG. 1 and further illustrating the removable nature of the side walls with respect to the base.

As seen in FIG. 4, each sidewall 40 is preferably provided with a first side flange 42, a second side flange 44 and a bottom flange 46. First side flange 42 can preferably extend along the first side edge of side wall 40, second side flange 44 can preferably extend along the second side edge of side wall 40 and bottom flange 46 can extend along the bottom edge of side wall 40. The lower inner area of sidewall 40 can be curved at 47, to help prevent or reduce damage to the contents stored within bin 20 (e.g. fruit, vegetables, etc.). Sidewall 40 can be preferably constructed from plastic, though other conventional materials can be used and are considered within the scope of the invention. Sidewall 40 can also be provided with one or more bushel markers 49.

Preferably, first side flange 42, second side flange 44 and bottom flange 46 are monolithically formed or constructed integral with side wall 40, though such is not considered is limiting. One or more, and preferably a plurality, of cutouts 48 can be provided at the top edge of sidewall 40 to define a gripping area and allow bin 20 to be moved by a conventional claw lifting apparatus. At least the top area of sidewall 40, where cutouts 48 are provided, can be constructed from reinforced plastic to help reduce breakage from connection to the conventional claw lifting apparatus. A plurality of apertures 50 can be provided in sidewall 40 to help reduce the overall weight of bin 20. A ticket/card/label holder 52 can be provided along sidewall 40 for holding identification or content information. Preferably, holder 52 is positioned along a lower half of sidewall 40 and recessed to help prevent the card/label from being damaged by a claw lifting apparatus attempting to lift bin 20 at the top of side wall(s) 40.

Base member 22 is preferably provided with four groves 24 extending along its perimeter edges at the top surface of base member 22. Grooves preferably terminate prior to reaching the corner areas of base member. Each groove 24 receives an associated bottom flange 46 of a sidewall 40 when assembling bin 20. As best seen in FIG. 4, bottom flange 46 of sidewall 40 is slid into groove 24 from either end of groove 24. The configuration of bottom flange 46 can preferably correspond to the configuration of groove 24, such that, side wall cannot be pulled out of secured attachment to base 22. Each corner area 26 of base 22 can have a recess or cutout 28, which also can preferably include an aperture 30 extending therethrough. Similar to sidewall 40, base 22 can include one or more cutouts 32 to help reduce the overall weight of bin 20. One or more feet 34 can be secured to the bottom surface of base 22. Preferably, feet 34 are monolithically formed or constructed integral with base 22. The locations of feet 34 along the bottom surface of base 22 permit a forklift prongs to lift bin 20 from any side. Furthermore, where base 22 is at least substantially square shaped, the location of feet 34 may also permit diagonal access to the forklift prongs (or other lifting device) for lifting bin 20. Additionally, one or more of perimeter located feet 34 can be offset for aiding in stacking of bins 20.

The interlocking joint relationship or securement of sidewalls 40 to base 22 maintains sidewalls 40 in their vertical position. However, it is preferred to also include corner posts 70 for further securement and retainment of sidewalls 40 in their vertical positions with respect to base 22. Each corner post 70 is provided with a first groove 72 extending along a first side edge and a second groove 74 extending along a second side edge. Each first groove 72 receives second flange 44 of one of sidewalls 40 and each second groove 74 receives first flange 42 of another one of sidewalls 40. To secure each of corner posts 70 to two of sidewalls 40, sidewalls 40 are preferably secured to base 22 as described above, and grooves 72 and 74 are aligned with corresponding flanges 42 and 44, respectively. Corner post 70 is then slid down until the bottom surface of corner post 70 abuts the top surface of base 22.

Where cutout 28 is provided, the shape of cutout 28 preferably generally corresponds to the shape of corner post 70 though such is not considered limiting. Thus, when corner post 70 is secured to two of sidewalls 40, the bottom surface of post 70 preferably abuts the top surface of base 22 within cutout 28.

Figures 6, 7A, 7B, 8:
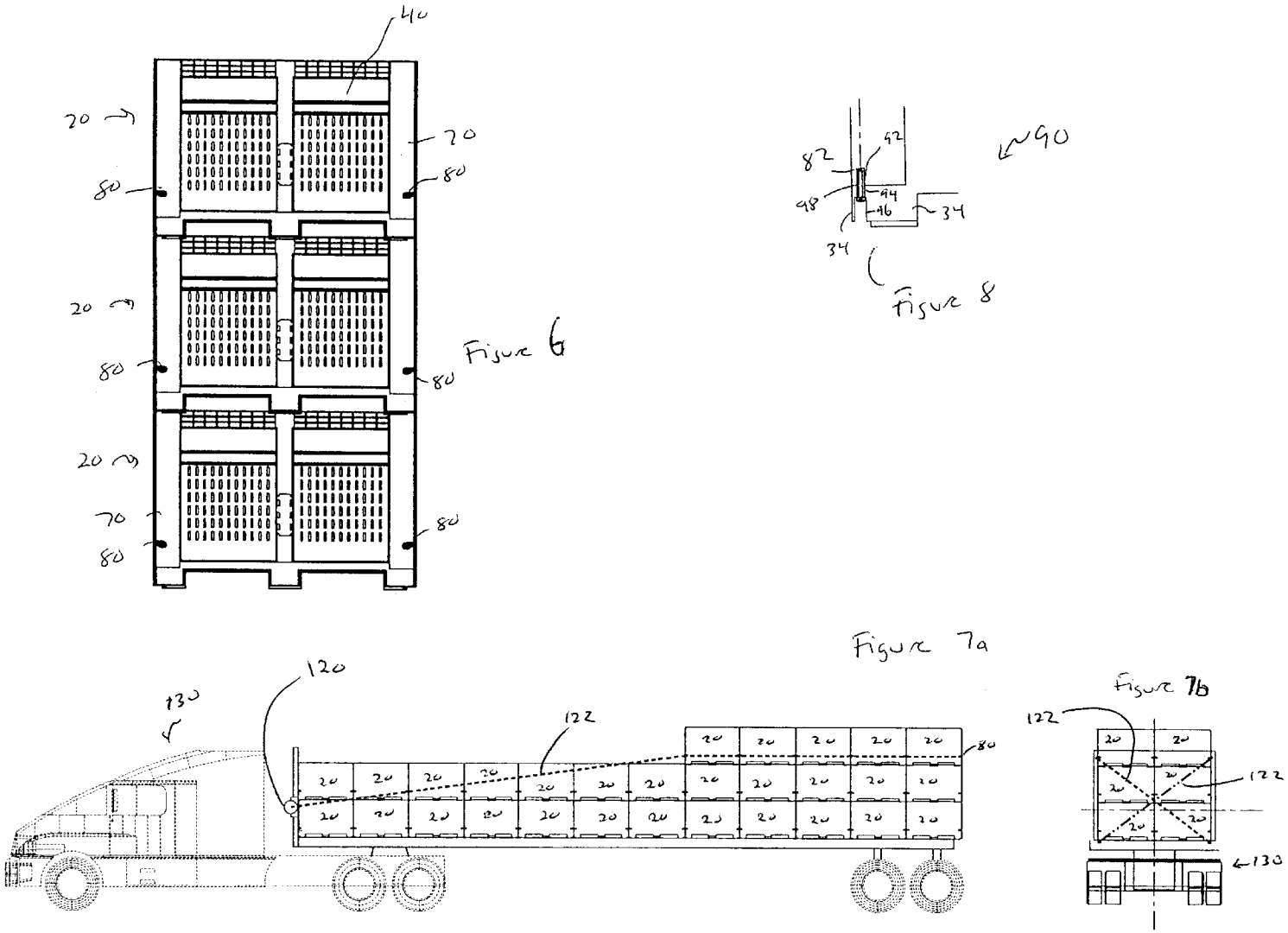
FIG. 6 is a side elevational view of the invention shown in FIG. 1 illustrating the stacking capabilities of the invention.
FIG. 8 is a sectional close up view of the mating of the bottom of a corner post to the base in accordance with the invention.

As seen in FIG. 8, to further retain corner posts 70 in their vertical position and/or to secure posts 70 directly to base 20 an attachment assembly 90 can be provided. In one embodiment, attachment assembly 90 can include a threaded sleeve or insert 92, preferably constructed from metal, which is disposed within a bottom aperture 82 of posts 70, an aperture 94 (preferably including a slot 96) disposed within base 22 and/or preferably corner feet 34, and a threaded bolt/screw 98. Insert 92 can be precast into bottom aperture 82 of posts 70. In this embodiment, when posts 70 are properly positioned, bottom aperture 82 and aperture 94/slot 96 are aligned with each other. Bolt 98 is inserted within apertures 82 and 94 and tightened by the mating of the threads on bolt 98 with the threads of sleeve 92. Sleeve 92 can be constructed from other materials other than metal including but not limited to aluminum, stainless steel, plastic, etc. Slot 96 provides a housing to conceal and protect the head of bolt/screw 98. Additionally, aperture 82 can itself be threaded to eliminate the need for a sleeve 92.

In an alternative attachment assembly, sleeve 92 is optional, and if provided is preferably without threads. A self-tapping bolt, as opposed to a threaded bolt is provided. The diameter of self-tapping bolt is chosen such that it is tightly received and retained within apertures 82 and 94. Bolt 98 and/or the self-tapping bolt can be constructed from plastic though other materials such as metal, stainless steel, aluminum, etc. can also be used and are considered within the scope of the invention. In one embodiment, bolt 98 can be a plastic hex bolt, having corse threads and a self-locking washer, though such is not considered limiting.

A top portion of corner posts 70 can preferably include a recessed area or cutout 76 and a top edge or ledge 78. Recessed area 76 can be shaped to correspond with an extended portion 36 of feet 34. Thus, when stacking bins 20, a non-extended portion 38 of feet 34 rest upon ledge 78 and the extended portion 36 is disposed within recessed area 76. Accordingly, any significant horizontal movement and/or shifting of the stacked bins 20 during transit is reduced and virtually eliminated.

As any non-perimeter located feet 34 will not contact either sidewalls 40 or corner posts 70 during stacking, the configuration or shape of such feet 34 does not have to be shaped with an extended portion 36 and non-extended portion 38, though such configuration can also be used with the non-perimeter feet 34. Furthermore, though it is preferred that the perimeter located feet 34 have the extended/non-extended configuration, it should be recognized that such is not considered limiting and other configurations can be used and all are considered within the scope of the invention.

Figure 9:
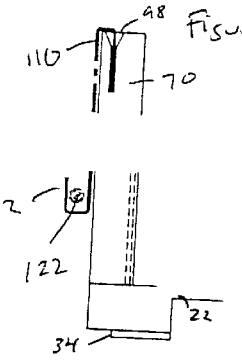
FIG. 9 is a side elevational view of a hook member which can be used for securing one or more bins of the present invention during transit in connection with a cable/wench assembly.
Figure 3:
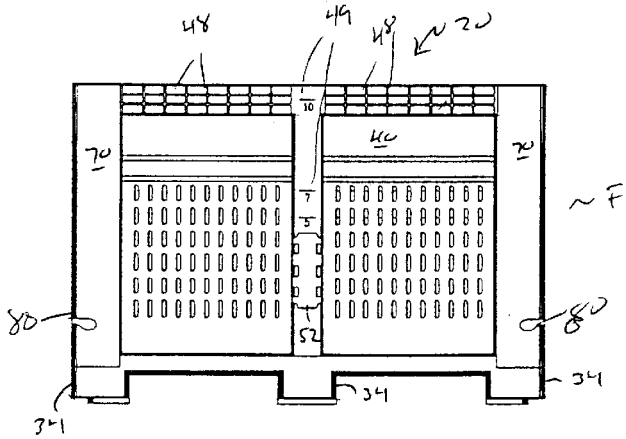
FIG. 3 is a side elevational view of the invention shown in FIG. 1.

One or more, and preferably all, of corner posts 70 can be provided with a notch 80 for receipt or disposal of a cable 122 from a winch assembly 120 disposed on a truck 130 when transporting full or empty bins 20 (See FIG. 7). Cable 122 wraps around the far end corner notch 80. Notch 80 eliminates the need for expensive brackets currently used in transporting shipping containers. However, whether or not notch 80 is provided, an aperture 98, preferably disposed on top edge 78, though other locations on corner post 70 are also within the scope of the invention. As seen in FIG. 9, aperture 98 is adapted for receipt of a portion of a hook member 110, such as but not limited to a S hook. Hook member 110 includes a receiving portion 112 adapted for receipt of cable 122 of winch assembly 120. It is also within the scope of the invention to provide one or more notches, similar to notch 80, with other shipping bins or containers, whether or not such other shipping bins or containers are collapsible and/or solid one piece units. Similarly, to bin 20, the notches also eliminate the need of special brackets when transporting such other shipping bins or containers. Additionally, apertures, similar to aperture 98, can be incorporated into such other shipping bins or containers for receipt of hook members.

Figure 5:
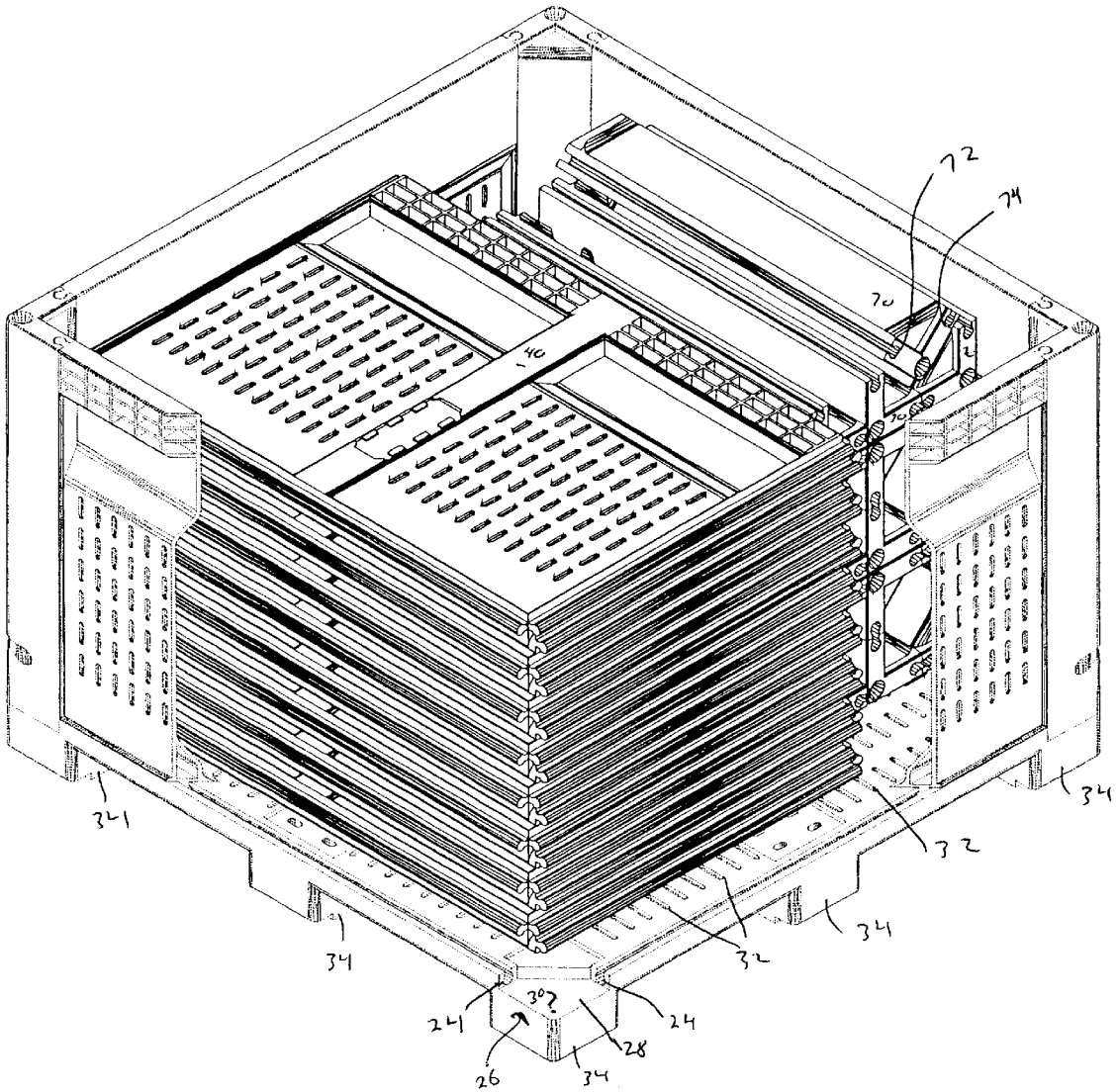
FIG. 5 is a perspective view of the invention shown in FIG. 1 partially cutaway to illustrate the collapsible nature of the invention for reduce space consumption in transporting the invention.

FIG. 5 illustrates a plurality of collapsed sidewalls 40 and corner posts 70 stored with an assembled bin 20, which shows the reduced space required for transporting back a plurality of empty bins 20 as compared to prior art containers. In addition to storage and shipping containers, it should also be recognized that the assembly and disassembly configuration and components of bin 20, can also be used for constructing other objects and structures such as, but not limited to, temporary storage structures and temporary dwellings.

Preferably, bin 20 is constructed from plastic, such as a H.P.D.E. plastic, though other materials, which will allow bin 20 to support the weight of one or more full stacked additional bins 20 can be selected and are also considered within the scope of the invention. Bin 20 can also be preferably acid, temperature and UV resistive. When stacked, forklift access is still provided for each bin 20. Bin 20 is not limited to any specific dimensions and all are considered within the scope of the invention. In one embodiment, the dimensions can be selected to correspond to current shipping containers, though such is not considered limiting.

In the event that a portion (e.g. sidewall 40, base 22 or corner post 70) of bin 20 becomes damaged, that portion is simply replaced. Thus, the entire bin or container does not have to be replaced. The shape of the grooves and flanges prevent sidewalls 40 from being pulled out their removable attachment to base 22 and also prevent sidewalls 40 from being pulled out of their removable attachment to corner posts 70.

The corner posts attachment assemblies provide an independent mechanism for retaining corner posts 70 in position from their removable connections to sidewalls 40. Thus, corner posts can be retained merely by the attachment assemblies (eliminating sidewall side flanges and corner posts corner grooves) or only by the sidewall side flanges and corner posts corner grooves (eliminating the attachment assemblies. Similarly, the sidewalls can be retained by their mating connection with the base or by their mating connection with the corner posts, and either one of these two mating connections can be eliminated and the sidewalls still be properly retained. Accordingly, all of these alternative embodiments are also considered within the scope of the invention.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. A structure comprising:

a base having a single substantially planar top surface, said base having a plurality of grooves disposed at its single substantially planar top surface, each of said plurality of grooves disposed along a majority perimeter length of a specific side of said base which is a different perimeter side from the perimeter sides associated with the remaining plurality of grooves, each of said plurality of grooves having a first end and a second end and being substantially uniform in size and shape from its first end to its second end;

a plurality of sidewalls, each of said sidewalls having a bottom surface and a bottom flange extending downward from said bottom surface, said bottom flange received within one said plurality of grooves for removably connecting said sidewall to said base by a non-foldable connection; and a plurality of corner posts, each of said corner posts removably connected to two of said plurality of sidewalls;

wherein when assembled said base, said plurality of sidewalls and said plurality of corner posts define a storage areas; wherein said base defines a bottom support surface for any content disposed within the storage area, wherein said base is monolithically formed as a one piece base.

2. The structure of claim 1 further including means for removably connecting each of said plurality of corner posts to said base.

3. The structure of claim 1 wherein said structure is a shipping container; wherein each of said corner posts are monolithically formed as one-piece corner posts.

4. The structure of claim 1 wherein said base is monolithically formed as a one piece base and each of said bottom flanges are monolithically formed with a corresponding sidewall bottom surface; wherein receipt of each bottom flange within each corresponding groove is achieved by slidably inserting each bottom flange beginning at a first end opening or a second end opening of each corresponding groove until the sidewalls are properly positioned with respect to said base; wherein the shape of each bottom flange and their corresponding grooves provides a non-rotatable connection and permits the plurality of sidewalls from being disconnected from said base only by sliding the bottom flanges out of either the first end or the second end of their corresponding grooves.

5. The structure of claim 1 wherein said plurality of grooves are disposed along a perimeter area of said top surface of said base, wherein each of said grooves having a first end opening and a second end opening for slidably receiving said bottom flange beginning at either said first end opening or said second end opening.

6. The structure of claim 1 wherein each of said plurality of corner posts having a first groove extending along a first side and a second groove extending along a second side and each of said plurality of sidewalls having a first side flange monolithically formed thereto and a second side flange monolithically formed thereto; wherein a second side flange of a first of said plurality of sidewalls mates with the first groove of one of said plurality of corner posts and a first side flange of a second of said plurality of sidewalls mates with the second groove of said one of said plurality of corner posts to removably connect said corner posts to two of said plurality of sidewalls; wherein mating of each side flange with each corresponding groove is achieved by slidably inserting each side flange beginning at a first end opening or a second end opening of each corresponding groove until the corner posts are properly positioned with respect to the sidewalls; wherein the shape of each side flange and their corresponding grooves permits the plurality of corner posts from being disconnected from said sidewalls only by sliding the bottom flanges out of the first end opening or the second end opening of their corresponding grooves.

7. The structure of claim 2 wherein said means for removably connecting includes a bolt member disposed and tightened within an aperture extending through said base and an aperture disposed at least at a bottom portion of a corresponding one of said plurality of corner posts.

8. The structure of claim 7 wherein said means for removably connecting further includes a threaded sleeve inserted within the aperture of said corner posts.

9. The structure of claim 1 wherein at least one of said plurality of corner posts is provided with a notch disposed at a lower portion of the at least one of said plurality of corner posts, said notch adapted for receipt of a cable from a winch assembly.

10. The structure of claim 1 wherein at least one of said plurality of corner posts is provided with a top aperture adapted for receipt of a hook member.

11. The structure of claim 1 wherein said base including a plurality of feet associated with a bottom surface of said base; wherein said plurality of feet are disposed along the bottom surface such that forklift access underneath said base is provided from at least one side of said base.

12. The structure of claim 11 wherein said plurality of feet are monolithically formed with said base.

13. The structure of claim 11 wherein at least one of said plurality of feet are offset.

14. The structure of claim 1 wherein at least one of said plurality of sidewalls includes a plurality of top cutouts adapted for receipt of a claw lifting apparatus.

15. The structure of claim 1 wherein at least one of said plurality of sidewalls includes a recessed holder disposed on a lower outer half portion of said at least one of said plurality of sidewalls.

16. A collapsible storage and shipping bin, comprising:

a one-piece non-separable base having a plurality of grooves extending along a top perimeter surface, each of said plurality of grooves disposed along a specific side of said base which is a different perimeter side from the perimeter sides associated with the remaining plurality of grooves, each of said plurality of grooves having a first end and second end and being substantially uniform in size and shape from its first end to its second end;

a plurality of sidewalls removably connected to said base, each of said plurality of sidewalls having a monolithically formed first side flange, a monolithically formed second side flange and a monolithically formed bottom flange;

a plurality of one-piece non-separable corner posts, each of said corner posts removably connected to two of said plurality of sidewalls, each of said plurality of corner posts having a first groove extending along a first side and a second groove extending along a second side; and means for removably connecting each of said plurality of corner posts to said base;

wherein each of said bottom flanges mates within a corresponding groove of said plurality of grooves to removably connect said plurality of sidewalls to said base in a non-foldable configuration;

wherein a second side flange of a first of said plurality of sidewalls mates with the first groove of one of said plurality of corner posts and a first side flange of a second of said plurality of sidewalls mates with the second groove of said one of said plurality of corner posts to removably connect said corner posts to two of said plurality of sidewalls;

wherein when assembled said base, said plurality of sidewalls and said plurality of corner posts define a storage areas; wherein said base defines a bottom support surface for any content disposed within the storage area.

17. The collapsible storage and shipping bin of claim 16 wherein said means for removably connecting includes a bolt member disposed and tightened within an aperture extending through said base and an aperture disposed at least at a bottom portion of a corresponding one of said plurality of corner posts.

18. The collapsible storage and shipping bin of claim 17 wherein said means for removably connecting further includes a threaded sleeve inserted within the aperture of said corner posts.

19. The collapsible storage and shipping bin of claim 16 wherein at least one of said plurality of corner posts is provided with a notch disposed at a lower portion of the at least one of said plurality of corner posts, said notch adapted for receipt of a cable from a winch assembly.

20. The collapsible storage and shipping bin of claim 16 wherein at least one of said plurality of corner posts is provided with a top aperture adapted for receipt of a hook member.

21. The collapsible storage and shipping bin of claim 16 wherein said base including a plurality of feet associated with a bottom surface of said base; wherein said plurality of feet are disposed along the bottom surface such that forklift access underneath said base is provided from at least one side of said base.

22. The collapsible storage and shipping bin of claim 21 wherein said plurality of feet are monolithically formed with said base.

23. The collapsible storage and shipping bin of claim 21 wherein at least one of said plurality of feet are offset.

24. The collapsible storage and shipping bin of claim 16 wherein at least one of said plurality of sidewalls includes a plurality of top cutouts adapted for receipt of a claw lifting apparatus.

25. The collapsible storage and shipping bin of claim 16 wherein at least one of said plurality of sidewalls includes a recessed holder disposed on a lower outer half portion of said at least one of said plurality of sidewalls.

26. A collapsible storage and shipping bin, comprising:

a base having a plurality of grooves extending along a top perimeter surface and a plurality of feet, said plurality of feet disposed along a bottom surface of said base such that forklift access underneath said base is provided from each side of said base;

a plurality of sidewalls removably connected to said base, each of said plurality of sidewalls having a monolithically formed first side flange, a monolithically formed second side flange and a monolithically formed bottom flange, each of said plurality of sidewalls includes a plurality of top cutouts adapted for receipt of a claw lifting apparatus;

a plurality of corner posts, each of said corner posts removably connected to two of said plurality of sidewalls, each of said plurality of corner posts having a first groove extending along a first side and a second groove extending along a second side, each of said plurality of corner posts is provided with a notch adapted for receipt of a cable from a winch assembly; and means for removably connecting each of said plurality of corner posts to said base;

wherein each of said bottom flanges mates within a corresponding groove of said plurality of grooves to removably connect said plurality of sidewalls to said base; wherein mating of each bottom flange with each corresponding groove is achieved by slidably inserting each bottom flange beginning at a first end or second end of each corresponding groove until the sidewalls are properly positioned with respect to said base; wherein the shape of each bottom flange and their corresponding grooves permits the plurality of sidewalls from being disconnected from said base only by sliding the bottom flanges out of either the first end or the second end of their corresponding grooves;

wherein a second side flange of a first of said plurality of sidewalls mates with the first groove of one of said plurality of corner posts and a first side flange of a second of said plurality of sidewalls mates with the second groove of said one of said plurality of corner posts to removably connect said corner posts to two of said plurality of sidewalls; wherein mating of each,side flange with each corresponding groove is achieved by slidably inserting each side flange beginning at a first end or second end of each corresponding groove until the corner posts are properly positioned with respect to the sidewalls; wherein the shape of each side flange and their corresponding grooves permits the plurality of corner posts from being disconnected from said sidewalls only by sliding the side flanges out of the first end or second end of their corresponding grooves;

wherein when assembled said base, said plurality of sidewalls and said plurality of corner posts define a storage areas; wherein said base defines a bottom support surface for any content disposed within the storage area.

27. The collapsible storage and shipping bin of claim 26 wherein said means for removably connecting includes a bolt member disposed and tightened within an aperture extending through said base and an aperture disposed at least at a bottom portion of a corresponding one of said plurality of corner posts.

28. The collapsible storage and shipping bin of claim 27 wherein said means for removably connecting further includes a threaded sleeve inserted within the aperture of said corner posts.

29. The collapsible storage and shipping bin of claim 26 wherein at least one of said plurality of corner posts is provided with a top aperture adapted for receipt of a hook member.

30. The collapsible storage and shipping bin of claim 26 wherein at least one of said plurality of feet are offset.

31. The collapsible storage and shipping bin of claim 26 wherein at least one of said plurality of sidewalls includes a recessed holder disposed on a lower outer half portion of said at least one of said plurality of sidewalls.

32. The structure of claim 1 wherein said bottom flange having a cross sectional shape which differs from a cross sectional shape of the sidewall which it extends downward from.

33. The collapsible storage and shipping bin of claim 16 wherein said bottom flange having a cross sectional shape which differs from a cross sectional shape of the sidewall which it extends downward from.

34. The structure of claim 6 wherein said first side flange and said second side flange each have a cross sectional shape which differs from a cross sectional shape of the sidewall which they extend outward from.

35. The structure of claim 16 wherein said first side flange and said second side flange each have a cross sectional shape which differs from a cross sectional shape of the sidewall which they extend outward from.

* * * * *